US005913602A

United States Patent [19]

Steele

[11] Patent Number: 5,913,602

[45] Date of Patent: Jun. 22, 1999

[54] ON-THE-GO MIXING SYSTEM

[75] Inventor: James R. Steele, Stillwater, Minn.

[73] Assignee: Dynamic Air Inc., St. Paul, Minn.

[21] Appl. No.: 08/767,279

[22] Filed: Dec. 16, 1996

[51] Int. Cl.[6] ..... B01F 7/04; B01F 15/02

[52] U.S. Cl. ..... 366/132; 366/156.2; 366/181.1; 366/186; 366/299

[58] Field of Search ..... 366/20, 27–29, 366/35, 38, 50, 64, 66, 132, 133, 134, 156.2, 158.1, 160.1, 186, 181.1, 194–196, 297–301, 603

[56] References Cited

U.S. PATENT DOCUMENTS

| | | | |
|---|---|---|---|
| 2,498,237 | 2/1950 | Baymond . | |
| 3,941,357 | 3/1976 | Wurtz . | |
| 4,278,355 | 7/1981 | Forberg | 366/300 |
| 4,443,109 | 4/1984 | Watts | 366/134 |
| 4,518,262 | 5/1985 | Bornemann et al. | 366/156.2 |
| 4,544,279 | 10/1985 | Rudolph | 366/156.2 |
| 4,548,507 | 10/1985 | Mathis et al. | 366/20 |

FOREIGN PATENT DOCUMENTS

| | | |
|---|---|---|
| 1097411 | 1/1961 | Germany . |
| 1112968 | 8/1961 | Germany . |
| 1116196 | 11/1961 | Germany . |

OTHER PUBLICATIONS

Hayes & Stolz Brochure.
Marion Process Equipment Brochure.
Littleford Polyphase Systems Brochure –Jan. 1989.

*Primary Examiner*—Charles E. Cooley
*Attorney, Agent, or Firm*—Jacobson & Johnson

[57] ABSTRACT

An apparatus and method of continually mixing material in a handling system wherein one delivers first material at a first delivery rate to a mixer and a second material at a second delivery rate to the mixer to allow the mixer to mix the first material and the second material to form a mixture of material. While the mixer is mixing the first and second materials, it continually delivers a mixture of material by use of a control unit that maintains the mixer discharge rate equal to the summation of the first delivery rate and the second delivery rate so that the mixer can continually maintain and mix the first material with the second material while delivering a mixture of material.

9 Claims, 2 Drawing Sheets

ON-THE-GO MIXING SYSTEM

FIELD OF THE INVENTION

This invention relates generally to mixing and, more particularly, to an on-the-go system for continuous mixing of materials and continuous delivery of a blended mixture of materials therefrom.

1. Background of the Invention

The mixing of two or more materials such as particulate materials is conventionally done with a batch mixture that mixes a first particulate material with a second particulate material. After mixing the particulate materials to form a blended mixture of particulate materials, a bombay door opens to discharge the batch of blended particulate materials. The batch mixing of particulate materials, while suitable for many applications, is generally unsuitable for use in systems in which materials are continuously processed. For example, in systems in which particulate materials are being continually processed, the time for mixing the batch of blended materials could delay operation of the system. The present invention provides an on-the-go system for simultaneously mixing two or more materials and the delivery of a blended mixture of materials.

2. Brief Description of the Prior Art

U.S. Pat. No. 4,278,355 shows a mixer for batch mixing of particulate materials with the mixer having trap doors for dumping the mixture of particulate materials after the particulate materials have been mixed.

U.S. Pat. No. 2,498,237 shows a feed-mixing machine with a series of paddles on the auger for mixing the feed.

U.S. Pat. No. 3,941,357 shows a method and apparatus for mixing viscous material using a set of plow-shaped paddles for mixing the viscous material.

German patent 1097411 shows a device for mixing materials.

German patent 1112968 shows another device for mixing materials.

German patent 1116196 shows a further device for mixing materials.

Hayes & Stolz brochure shows a mixing apparatus that uses counter-rotating ribbon spirals.

Marion Process Equipment brochure discloses an horizontal paddle and ribbon mixer.

Littleford brochure discloses a mixer that uses a fluidized bed and plow-shaped paddles to mix solids, powders or granules.

SUMMARY OF THE INVENTION

Briefly, the invention comprises an apparatus and a method of continually mixing two or more materials wherein one delivers a first material at a first delivery rate to a mixer and a second material at a second delivery rate to the mixer to allow the mixer to mix the first material and the second material to from a blended mixture of materials. While the first and second materials are being mixed, the mixer continually delivers a blended mixture of material from the mixer by a control unit that maintains the mixer discharge rate equal to the summation of the delivery rate of the first material and the delivery rate of the second material so that the mixer can continually maintain a predetermined level of materials within the mixer.

DESCRIPTION OF THE PREFERRED EMBODIMENT

Figure 1:
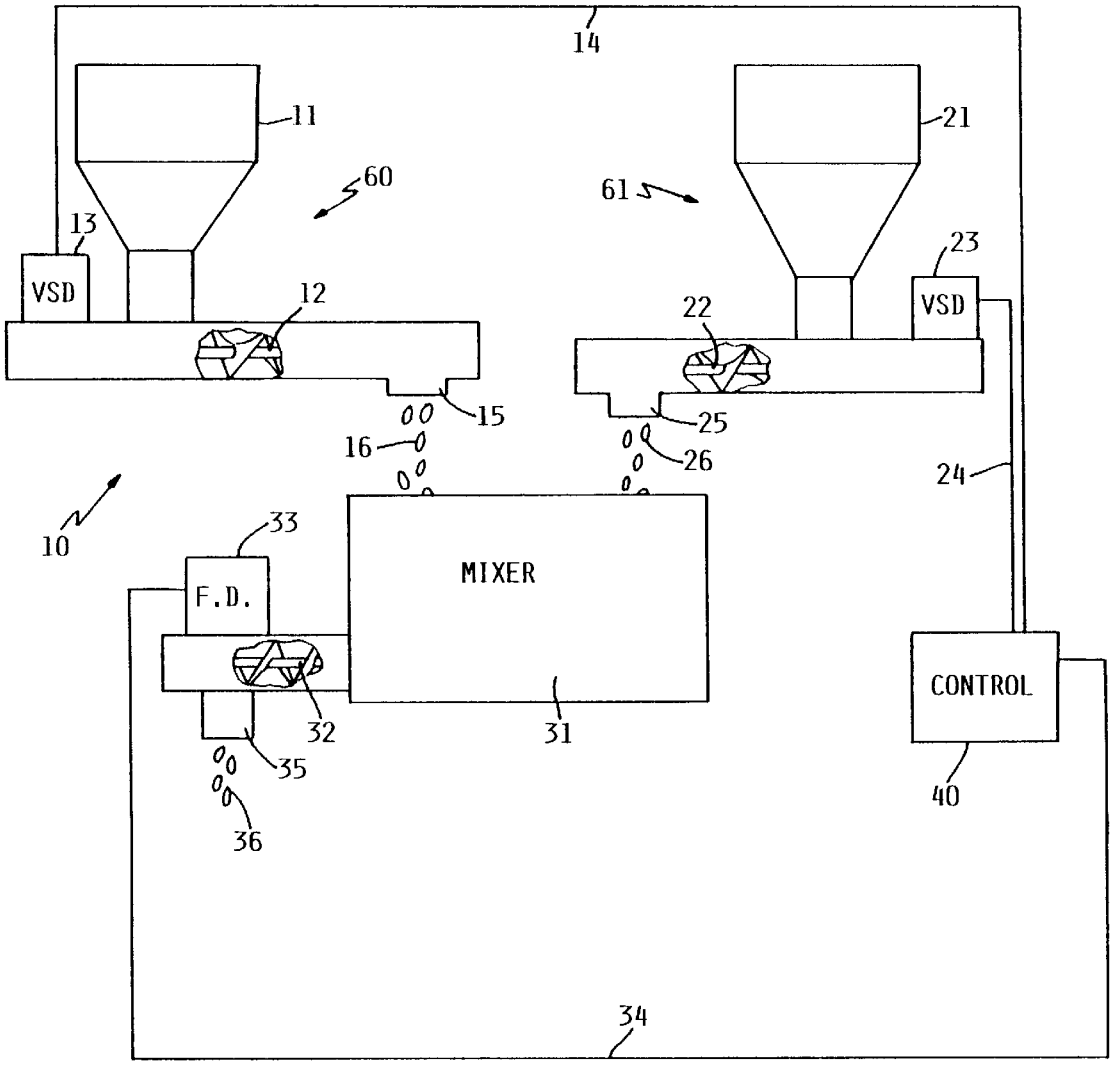
FIG. 1 shows a block diagram of the system for on-the-go mixing of two particulate materials and simultaneously delivering a mixture of particulate materials therefrom.

FIG. 1 shows a block diagram of an on-the-go system 10 for simultaneously mixing two or more materials and delivering a blended mixture of the materials therefrom. System 10 includes a first hopper 11 for holding a first particulate material with the hopper 11 having a first variable-speed auger drive comprised of a variable-speed drive unit 13 and an auger 12 for delivering the first particulate material 16 from the hopper 11. A spout 15 discharges the first particulate material 16 to a mixer 31.

Similarly, system 10 includes a second hopper 21 for holding a second particulate material with the hopper 21 having a second variable-speed auger drive comprised of variable-speed drive unit 23 and an auger 22 for delivering the second particulate material 26 from the hopper 21. A spout 25 discharges the second particulate material 26 to a mixer 31.

Figure 2:
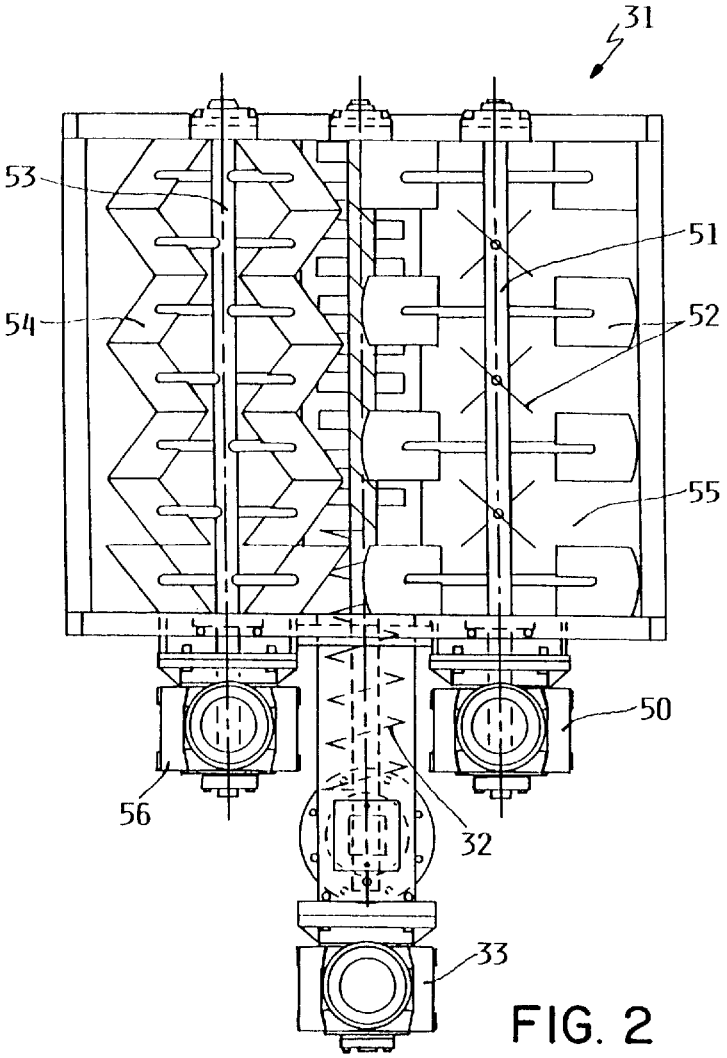
FIG. 2 shows a top view of a mixing system for mixing materials and continually delivering mixed materials therefrom.
Figure 3:
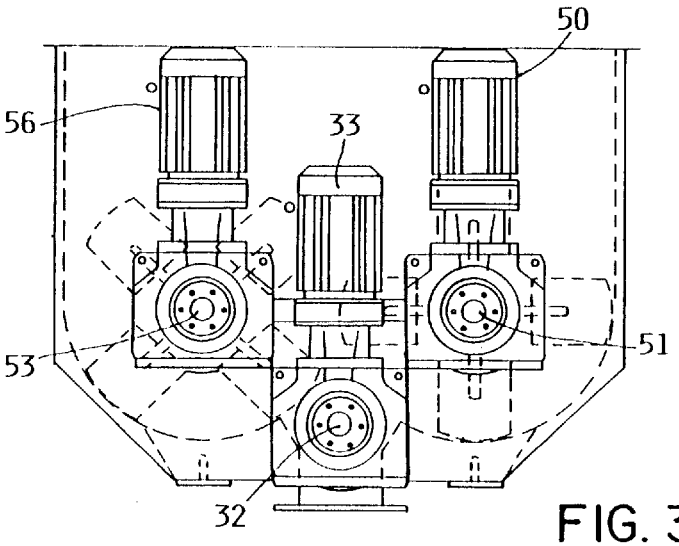
FIG. 3 shows an end view of the mixing system of FIG. 2.

Mixer 31 includes mixing paddles, which are shown in greater detail in FIGS. 2 and 3, for blending the two materials 16 and 26, and an auger 32 and auger drive drive unit 33 for auguring a blended mixture of materials 36 to a discharge chute 35 so that the blended mixture of particulate materials 36 can be delivered therefrom.

The reference to blended materials is intended to identify a mixture of two or more materials wherein the proportion of materials delivered to the mixer is the same as the proportions of mixture found in a sample of mixed materials being discharged from the mixer. That is, if 60 percent of one material were being delivered to the mixer and 40 percent of a second material were being delivered to the mixer, the blended mixture being discharged as a single material would contain 60 percent of the first material and 40 percent of the second material.

In the embodiment shown the materials 16 and 26 are being delivered to the top of mixer 31. The paddles in mixer 31 mix the two materials so that by the time the two materials are at the bottom of the mixer they form a blended mixture. The auger 32 allows the blended materials to be continually removed from the bottom of the mixture while the unblended materials are blended together in the upper portion of the mixer.

To control the delivery rate of blended material and the delivery rate of the first and second materials, system 10 includes a control unit 40 which can be a computer or the like. A lead 14 connects the control unit 40 to variable-speed drive unit 13. Similarly, a lead 24 connects the control unit 40 to the variable-speed drive unit 23. A third lead 34 connects control unit 40 to the auger drive unit 33. In operation of the system, control unit 40 monitors and controls the auger delivery rate of mixer 31 through auger drive unit 33 by controlling the speed of rotation of the auger. In addition, control panel 40 monitors and maintains the first variable-speed drive 13 and the second variable-speed auger drive 22 in correct relative rotational speed to each other to maintain the proper proportion of particulate materials delivered to mixer 31, while simultaneously, control unit 40 maintains the combined delivery rate of material from the first variable-speed auger drive 13 and the second variable-speed auger drive 23 equal to the delivery rate of the blended materials 36 to continuously maintain the first material and the second material in in a mixing state in mixer 31 while continually delivering the mixture of material 36 therefrom.

FIG. 1 shows system 10 with hopper 11 for holding a first particulate material to be mixed and hopper 21 for holding a second particulate material to be mixed; however, system 10 can be part of a continuous delivery system that mixes particulate materials from continuous delivery systems.

FIG. 2 shows a mixer 31 for use with the present invention. Mixer 31 includes a bin 55 with a first rotatable shaft 51 extending thereacross which is driven by drive unit 50. A set of first mixing paddles 52 are located on shaft 51. Located on the opposite side of bin 55 is a second rotatable shaft 53 extending thereacross which is driven by drive unit 56. A set of second mixing paddles 54 are located on shaft 53.

Located extending across the bottom of bin 55 is auger 32 for augering the mixed or blended materials from mixer 31. In operation of the system, paddles 52 and 54 create a mixing zone above auger 32 so that the materials which are being fed to the lower auger 32 arrive in a blended state to enable auger 32 to deliver the blended material from the mixer 31. That is, with the mixer shown, the two materials are mixed in the upper portion of the mixture in the region occupied by the paddles so that by the time the materials arrive at the bottom of the mixer they are thoroughly blended together. The blended mixture can be removed from the bottom of the mixer 31 while unblended materials are added to the top of the mixture. By keeping the rate of discharge of blended materials from the mixer equal to the rate of input of unblended materials to the mixer, one can maintain a predetermined level of materials in the mixer.

The mixer offers a further advantage in that the amount of materials in the mixer can be adjusted by controlling discharge auger 32. That is, if one wants more materials in mixer 31, one can temporarily slow down discharge auger 32 so that material builds up in the mixer. In addition, when the system is started, one can temporarily reverse auger 32 so that mixer 31 does not deliver materials. This allows the materials in mixer 31 to increase to the desired level. At that point, auger 32 can be activated to deliver the blended materials from the mixer.

FIG. 3 shows an end view of mixer 31 with auger 32 positioned below the mixing zone formed by paddles 52 and 54 so that the blended mixture can be continually removed from the mixture while the unblended materials are being delivered to the mixer.

While the system has been described with respect to mixing of two particulate materials, the system can be used to mix other types of materials as well as two or more materials.

Thus the present invention provides an on-the-go mixing system 10 for continually mixing a plurality of materials with mixer 31 operable for delivering a blended mixture 36 of material therefrom at a first delivery rate. The system includes a first material delivering unit 60 for delivering the first material to mixer 31 at a second delivery rate and a second material delivering unit 61 for delivering a second material to mixer 31 at a third delivery rate. A control unit 40 controls at least one of the delivery rates to control the delivery rate of a blended mixture 36 from mixer 31.

I claim:

1. An on-the-go mixing system for continually mixing a plurality of materials comprising:

a mixer, said mixer including a first auger for delivering a blended mixture of material therefrom at a first delivery rate;

a first hopper for holding a first material, said hopper including a first variable-speed auger drive for delivering the first material to said mixer at a second delivery rate;

a second hopper for holding a second material, said hopper including a second variable-speed auger drive for delivering the second material to said mixer at a third delivery rate;

a control unit for controlling the second variable-speed auger drive and the first variable-speed auger drive to maintain the combined delivery rate of the second variable-speed auger drive and the first variable-speed auger drive equal to the first delivery rate to continuously maintain the first material and the second material in a mixing state in said mixer while continually delivering the blended mixture of material therefrom.

2. The system of claim 1 including control means for temporarily reversing the first auger to allow material to accumulate to a predetermined level in said mixer.

3. The system of claim 1 wherein said mixer includes a mixing chamber having an upper portion and a lower portion with a plurality of mixing paddles located in said upper portion for mixing said materials.

4. The system of claim 1 wherein said first auger is located in the bottom of said mixer for delivering blended material from said mixer.

5. The system of claim 1 wherein said materials comprise particulate materials.

6. The system of claim 1 wherein said mixer includes a first spout for delivering said first material to a top portion of the mixer and a second spout for delivering said second material to the top portion of said mixer.

7. The system of claim 6 wherein said auger in said mixer is located in a lower portion of said mixer for delivering blended materials from said mixer while unblended materials are being fed into said mixer.

8. The system of claim 7 including at least two sets of rotatable mixing paddles in said mixer.

9. The system of claim 8 wherein said two sets of rotatable mixing paddles are located above said auger in said mixer so that the materials are blended in an upper portion of said mixer.

* * * * *